US007418898B1

(12) United States Patent
Desomma

(10) Patent No.: US 7,418,898 B1
(45) Date of Patent: Sep. 2, 2008

(54) M16 MODIFIED WITH PUSHROD OPERATING SYSTEM AND CONVERSION METHOD

(76) Inventor: Frank Desomma, 23623 N. 67th Ave., Glendale, AZ (US) 85310

( * ) Notice: Subject to any disclaimer, the term of this patent is extended or adjusted under 35 U.S.C. 154(b) by 410 days.

(21) Appl. No.: 11/056,306

(22) Filed: Feb. 11, 2005

Related U.S. Application Data

(60) Provisional application No. 60/543,981, filed on Feb. 11, 2004.

(51) Int. Cl.
*F41A 5/26* (2006.01)

(52) U.S. Cl. ..... 89/193; 89/191.02

(58) Field of Classification Search ..... 89/191.01, 89/191.02, 192, 193
See application file for complete search history.

(56) References Cited

U.S. PATENT DOCUMENTS 1,738,501 A * 12/1929 Moore ..... 89/193
2,482,880 A * 9/1949 Sefried ..... 89/193

* cited by examiner

*Primary Examiner*—Stephen M Johnson
(74) *Attorney, Agent, or Firm*—Parsons & Goltry; Robert A. Parsons; Michael W. Goltry

(57) ABSTRACT

A push rod operating system for an AR-15/M-16 rifle includes an AR-15/M-16 rifle having a barrel coupled to an upper receiver, a bolt carrier carried by the upper receiver, and a mechanical key coupled to the bolt carrier. A gas block is coupled to the barrel, the gas block having a bore therethough. A rod tube extends from the gas block in communication with the bore, toward the upper receiver. A gas plug has a gas chamber closing the bore of the gas block opposite the rod tube. A discharge gas pathway permits discharge gasses to enter the gas chamber from the barrel. A piston rod element is carried in the rod tube with a piston portion thereof reciprocally received within the bore of the gas block and movable between a first position abutting the gas plug to define an operating volume, and a second position. A push rod element is carried by the rod tube and engages the mechanical key and the piston rod element.

2 Claims, 6 Drawing Sheets

10
12
14
16
20
21
22
23
26
31
BRAKE/FLASH HIDER
BARREL
OP-ROD/PUSH ROD
BARREL NUT

FAL GAS PLUG WITH ADDITIONAL CAVITY/1/4 TURN
GAS BLOCK/PICATINNY GAS BLOCK
BARREL NUT
FAL GAS PLUG/1/4 TURN
EXHAUST HOLES
MECHANICAL BOLT KEY
AR-15/M-16 UPPER
30
38
39
24

M16 MODIFIED WITH PUSHROD OPERATING SYSTEM AND CONVERSION METHOD

CROSS-REFERENCE TO RELATED APPLICATION

This application claims the benefit of U.S. Provisional Application No. 60/543,981, filed 11 Feb. 2004.

FIELD OF THE INVENTION

This invention relates to firearms.

More particularly, the present invention relates to operating systems for the firing cycle of firearms.

BACKGROUND OF THE INVENTION

Several problems are prevalent in a conventional AR-15/M-16 gas operated operating system. Chief among these are deposits of residues from discharge gasses, decreasing reliability and usability of the rifle. Deposits inhibit the proper operation of the firearm, requiring frequent cleaning of the gas operating system. Additionally, performing the cleaning in field conditions is difficult and requires specialized tools which may not be present.

It would be highly advantageous, therefore, to remedy the foregoing and other deficiencies inherent in the prior art.

Accordingly, it is an object the present invention to provide a new and improved operating system for an AR-15/M-16 rifle.

Another object of the present invention is to provide a push rod operating system for an AR-15/M-16 rifle.

And another object of the present invention is to provide a method of converting an AR-15/M-16 rifle to a push rod operating system.

SUMMARY OF THE INVENTION

Briefly, to achieve the desired objects of the present invention in accordance with a preferred embodiment thereof, provided is a push rod operating system for an AR-15/M-16 rifle having a barrel coupled to an upper receiver. The operating system includes a gas block coupled to the barrel, the gas block having a bore therethough. A rod tube extends from the gas block in communication with the bore, toward the upper receiver. A gas plug closes the bore of the gas block opposite the rod tube, the gas plug defining a gas chamber therein. A discharge gas pathway extends concurrently through the barrel and the gas block to the gas chamber defined by the gas plug. A piston rod element is carried in the rod tube proximate the gas block. The piston rod element has a piston portion reciprocally received within the bore of the gas block and movable between a first position abutting the gas plug to define an operating volume, and a second position. A push rod element is carried by the rod tube between the upper receiver and the piston rod element. The discharge gas pathway can extend into the gas chamber through an aperture in the wall of the gas plug, or through an aperture in the piston portion and into a gas chamber formed therein in communication with the gas chamber of the gas plug.

In a further embodiment a gas key on the bolt carrier is replaced with a mechanical key. Additionally, in a specific aspect, the conversion utilizes an FAL gas tube, an FAL push rod/piston rod, and an FAL gas plug.

A method of converting an AR-15/M-16 rifle to a push rod operating system is also provided. The steps of the method include providing an AR-15/M-16 rifle including a barrel coupled to an upper receiver, and a bolt carrier carried by the upper receiver. A gas block is provided and coupled to the barrel, the gas block having a bore therethough and an aperture aligned with an aperture in the barrel to provide a pathway for discharge gasses into the gas block. A mechanical key is attached to the bolt carrier and a rod tube is coupled to the gas block with the rod tube extending from the gas block in communication with the bore, toward the upper receiver. The bore of the gas block opposite the rod tube is closed with a gas plug, the gas plug defining a gas chamber therein. A piston rod element is positioned in the rod tube proximate the gas block, the piston rod element having a piston portion reciprocally received within the bore of the gas block and movable between a first position abutting the gas plug to define an operating volume, and a second position. A push rod element is positioned in the rod tube engaging the mechanical key and the piston rod element.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF THE PREFERRED EMBODIMENTS

Figures 1, 2, 3:
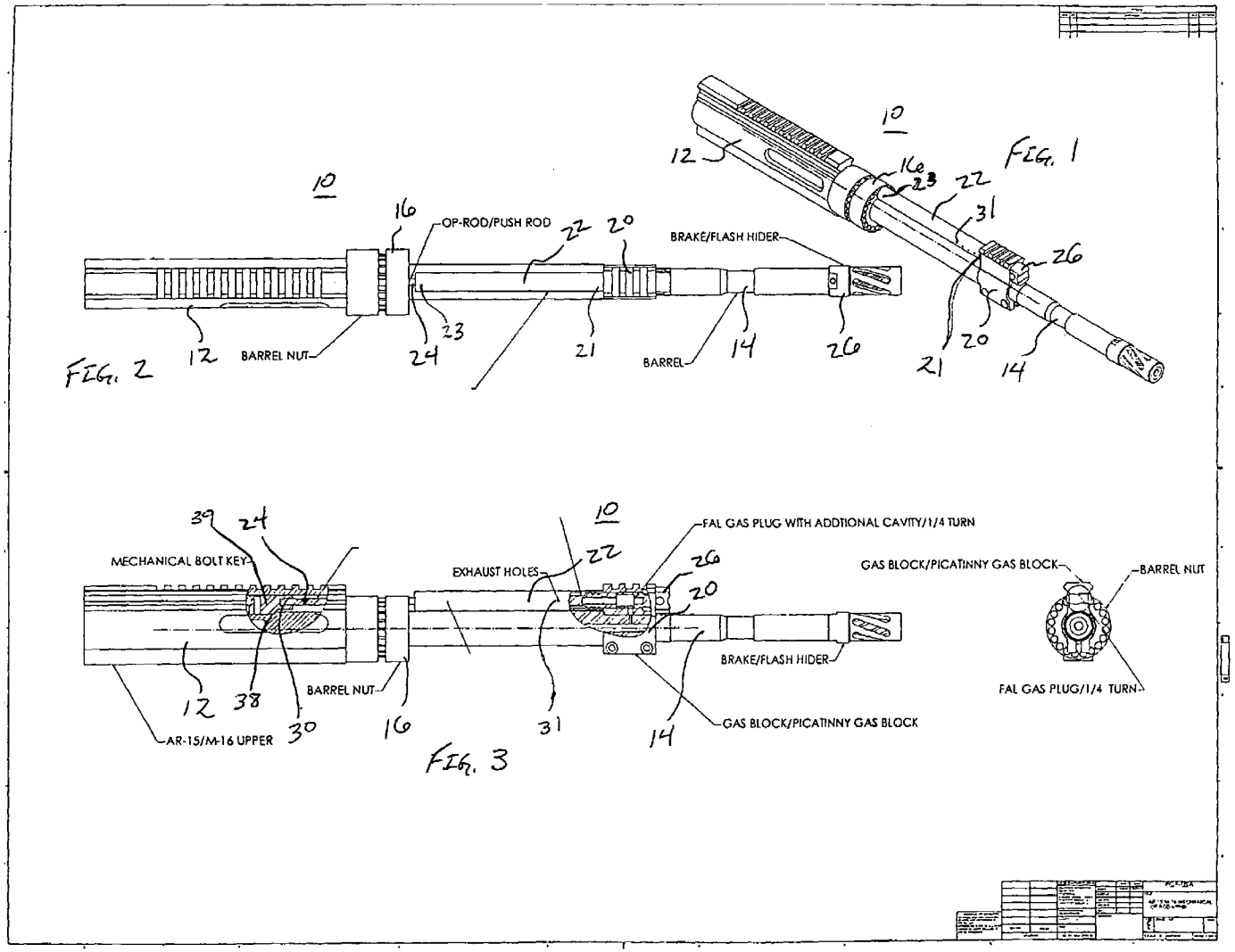
FIG. 1 is a perspective view of an upper receiver and barrel of an M-16 rifle modified with a pushrod system according to the present invention.
FIG. 2 is a top view of the partial rifle of FIG. 1.
FIG. 3 is a side view of the partial rifle of FIGS. 1 and 2, with portions thereof cut-away.

Turning now to the drawings in which like reference characters indicate corresponding elements throughout the several views, attention is first directed to FIGS. 1 and 2 which illustrate a partial rifle generally designated 10. An entire AR-15/M-16 rifle is not illustrated as they are well known in the art. The portion of the rifle illustrated is sufficient to show the modifications of the present invention, and the remainder of the rifle is assumed to be of conventional or known construction. Partial rifle 10 includes an upper receiver 12 to which a barrel 14 is attached using a barrel nut 16. In this embodiment, a barrel nut, and handguard system (not shown) is employed. Barrel nut 16 is employed, as it is constructed to accommodate a pushrod as will be described presently. Details of barrel nut 16 and a handguard will not be described in detail as they are disclosed in U.S. patent application Ser. No. 10/105,700 filed 25 Mar. 2002, herein incorporated by reference. It should also be understood that other barrel attachment mechanisms that permit passage of a push rod can be employed.

In a conversion method, the conventional gas operating system has been removed from an AR-15/M-16 rifle and replaced with a pushrod system consisting of a gas block 20, a rod tube 22 extending therefrom, a push rod/piston rod 24, and a gas plug 26. As can be seen, rod tube 22 includes an outer end 21 towards the muzzle of barrel 14 and engaging and terminating at gas block 20, and an inner end 23 toward upper receiver 12 and, in this embodiment, terminating adjacent barrel nut 16. Gas block 20 replaces a conventional gas block and includes a bore extending longitudinally therethrough in communication with rod tube 22. Gas plug 26 is removably received in and seals the bore of gas block 20 opposite rod tube 22. Push rod/piston rod 24 consists of two elements, a push rod element and a piston rod element which can be separate abutting elements or integrally formed into a single piece. It will be understood that while a conversion method is described, a newly fabricated rifle with new parts can also be fabricated according to the present invention.

With additional reference to FIG. 3, the preferred operating system of the present invention can employ various elements of the FAL rifle operating system to simplify, reduce cost and improve reliability of the AR-15/M-16 rifle. By employing the FAL gas plug 26 or one of FAL type design, a quick attaching, easily removable and cleanable access to gas block 20 is provided for facilitating maintenance and cleaning. Use of elements of the FAL operating system or elements produced based on FAL designs and specifications, requires unique and novel modifications to the elements and to the AR-15/M-16 rifle. The systems are incompatible due to numerous differences in the rifles, such as caliber and gas pressures generated by the discharge gasses of ignited cartridges. It was found that by modifying the push rod/piston rod 24 and rod tube 22 of the FAL, they could, along with gas plug 26 be used on an AR-15/M-16 rifle, with additional modifications to the rifle as will be described presently. The push rod/piston rod 24 must have push rod element 30 reduced in diameter in order to be received within a conventional upper receiver 12. Rod tube 22 can have exhaust holes 31 repositioned to further facilitate proper operation. However, even with these modifications, cyclic firing rates are too high. The high rates prevent the proper operation of the conventional trigger assembly, and can cause damage to the rifle.

Figure 4:
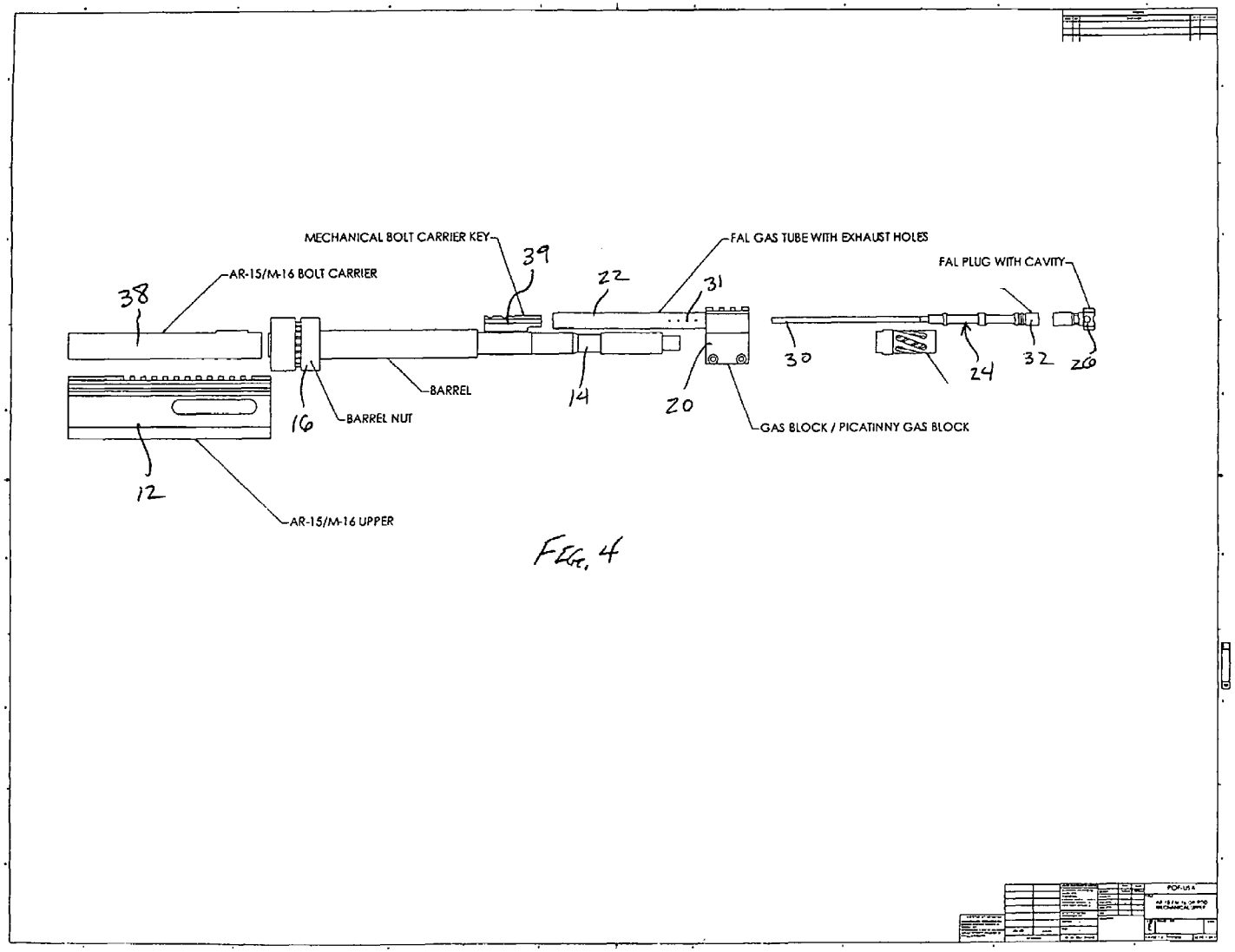
FIG. 4 is an exploded side view of the partial rifle of FIGS. 1-3, illustrating the elements of the operating system modification.
Figure 5:
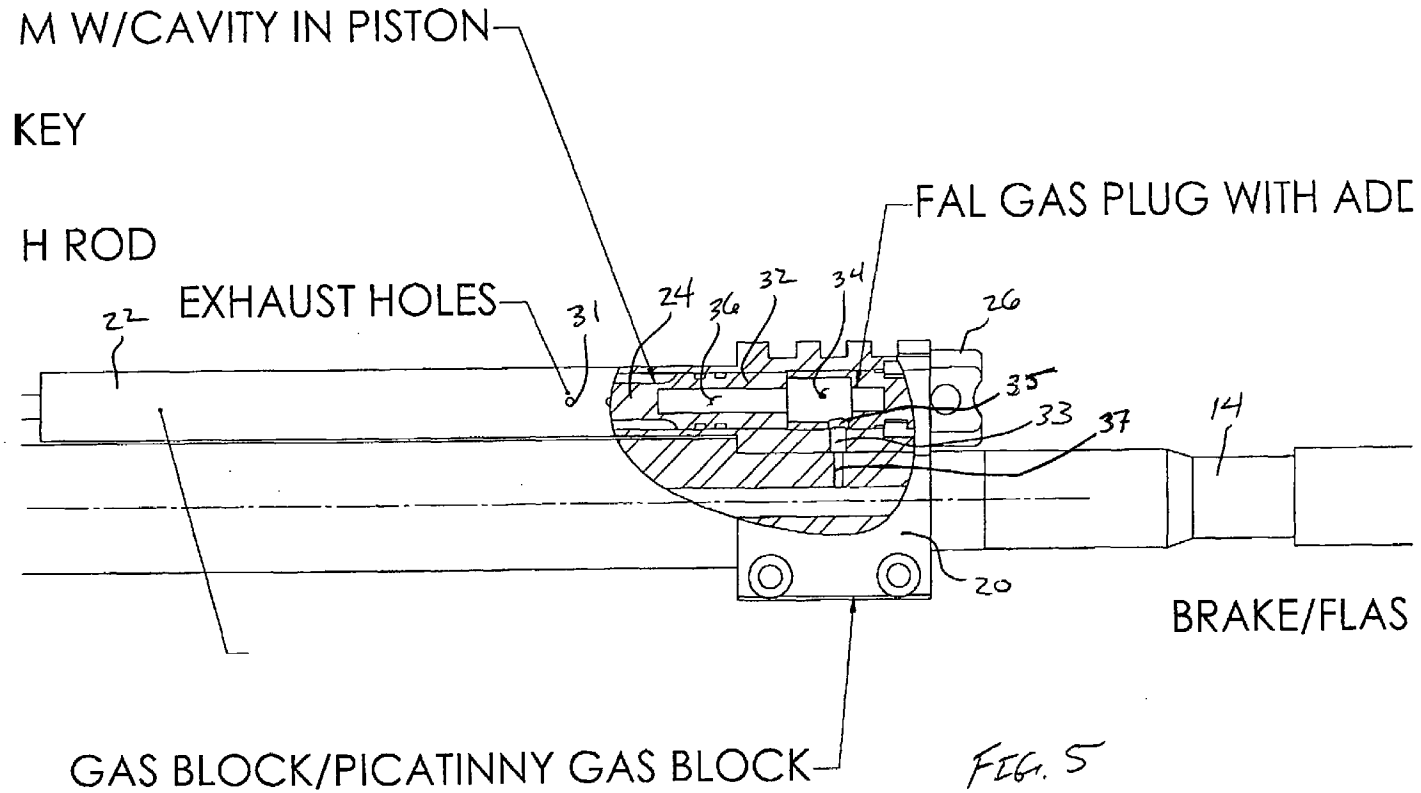
FIG. 5 is an enlarged sectional side view of the forward portion of the operating system of FIG. 3.

Still referring to FIG. 3, with additional reference to FIGS. 4 and 5, discharge gas from barrel 14 enters a gas chamber 34 defined by gas plug 26. Different gas pathways can be employed, and will be described herein. In this embodiment, the discharge gasses enter through aperture 33, formed through a bottom of gas block 20, and an aperture 35 formed in gas plug 26, each aligned with an aperture 37 formed in barrel 14. A piston portion 32 of push rod/piston rod 24 is reciprocally received within the bore of gas block 20, abutting gas plug 26 and closing gas chamber 34. Piston portion 32 is movable between a first position abutting the gas plug, and a second position, shifted rearwardly in the direction of upper receiver 12. It has been determined through experimentation that the volume of gas chamber 34 must be modified for proper operation of the AR-15/M-16 rifle. This has been accomplished by forming a gas chamber 36 in piston portion 32 of push rod/piston rod 24 which, combined with gas chamber 34, increases the joint volume to an operating volume for receiving the gasses. Conversely, gas plug 26 can be modified by increasing the original volume of chamber 34 to the operating volume.

Figure 7:
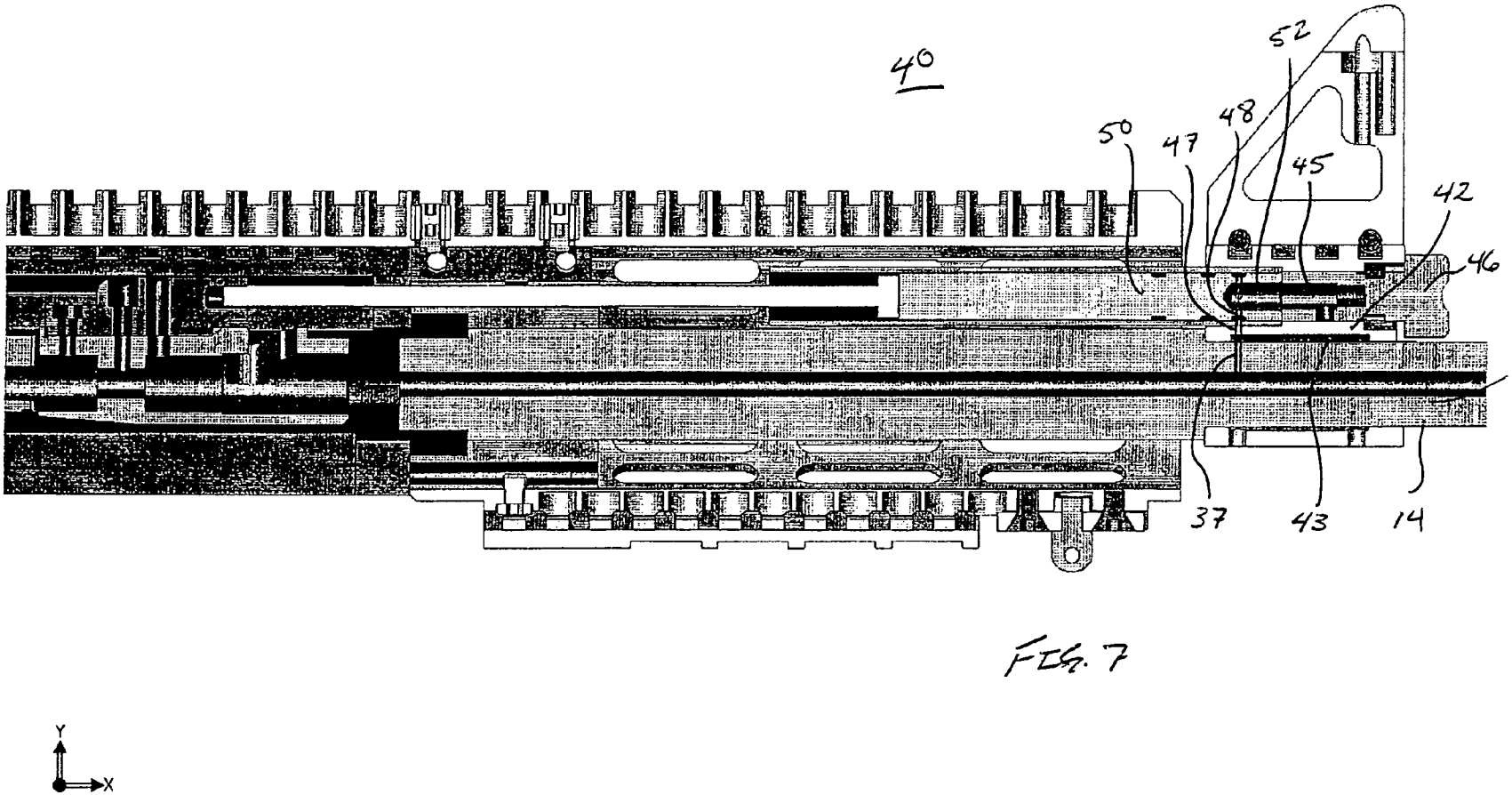
FIG. 7 is a side view of the partial rifle of FIGS. 1 and 2, with portions thereof cut-away and another embodiment of a push rod operating system installed.

Referring now to FIG. 7 another embodiment of an operating system is illustrated in rifle portion 40. In this embodiment, a gas block 42 is illustrated including, an antechamber 43 to collect and contain some gas before filling a gas chamber 45 in gas plug 46. This has the net effect of acting as if the original volume of chamber 45 were increased to the operating volume. This is considered a direct impingement system. In this embodiment, the discharge gas pathway is formed from aperture 37 in barrel 14 into antechamber 43, then through an aperture 47 in gas block 42 and an aperture 48 in a piston portion 50. Aperture 48 couples to a gas chamber 52 formed in piston portion 50 which forms a joint volume with gas chamber 45 of gas plug 46. It will be understood that the discharge gas pathway can extend from antechamber 43 through aligned apertures in gas block 42 and gas plug 46.

Figure 8:
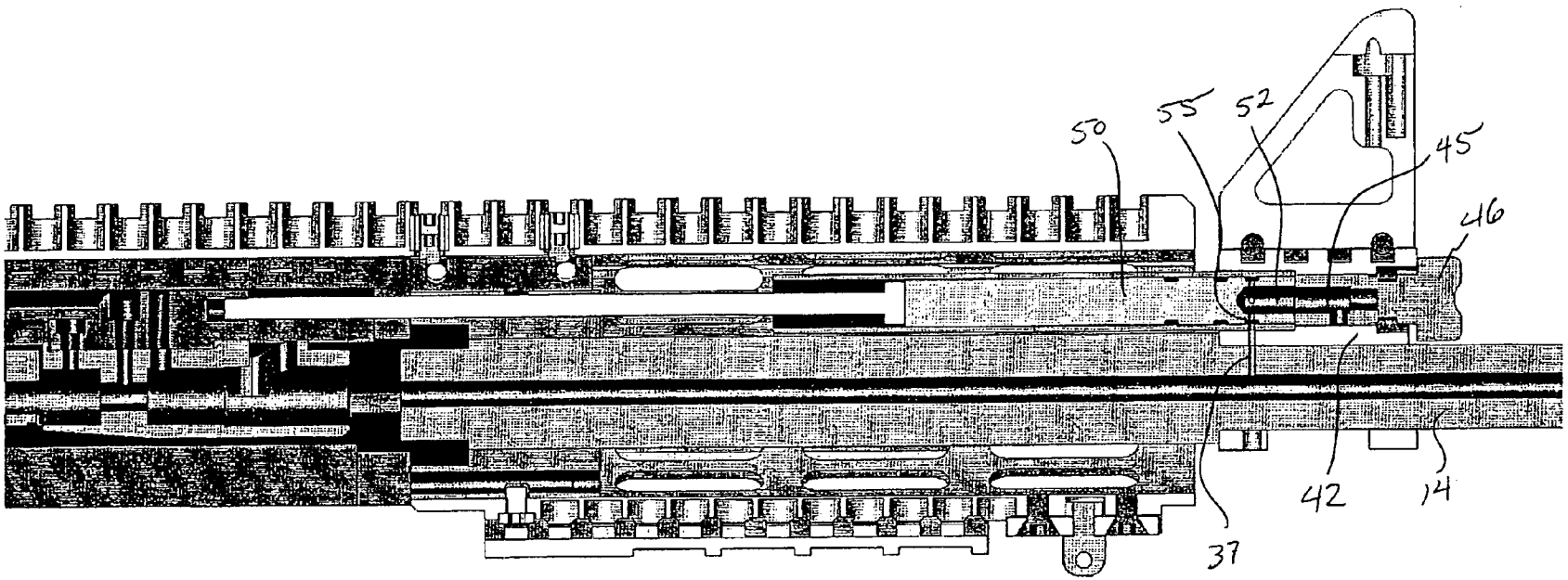
FIG. 8 is a side view of the partial rifle of FIGS. 1 and 2, with portions thereof cut-away and yet another embodiment of a push rod operating system installed.

Turning to FIG. 8, in yet another embodiment, a gas trap system can be employed. In this embodiment, the gas pathway is an aperture 55 formed through piston portion 50 in communication through the side of piston portion 50 with gas cavity 52. Gas from barrel 14 is vented through this aperture and into piston gas cavity 52 instead of gas cavity 45 of gas plug 46 as with the previous embodiment, without the additional volume provided by an antechamber.

The gas volume can also be modified by the positioning, size and quantity of exhaust apertures 31 formed in rod tube 22. As push rod/piston rod 24 moves rearwardly during operation, exhaust apertures 31 can be positioned to vent gas collected by cavity 34 sooner and adjusted to have a diameter which will vent the gas in greater quantity. Additionally, the length of the barrel of the rifle will affect the proper positioning and size of the apertures.

Figure 6:
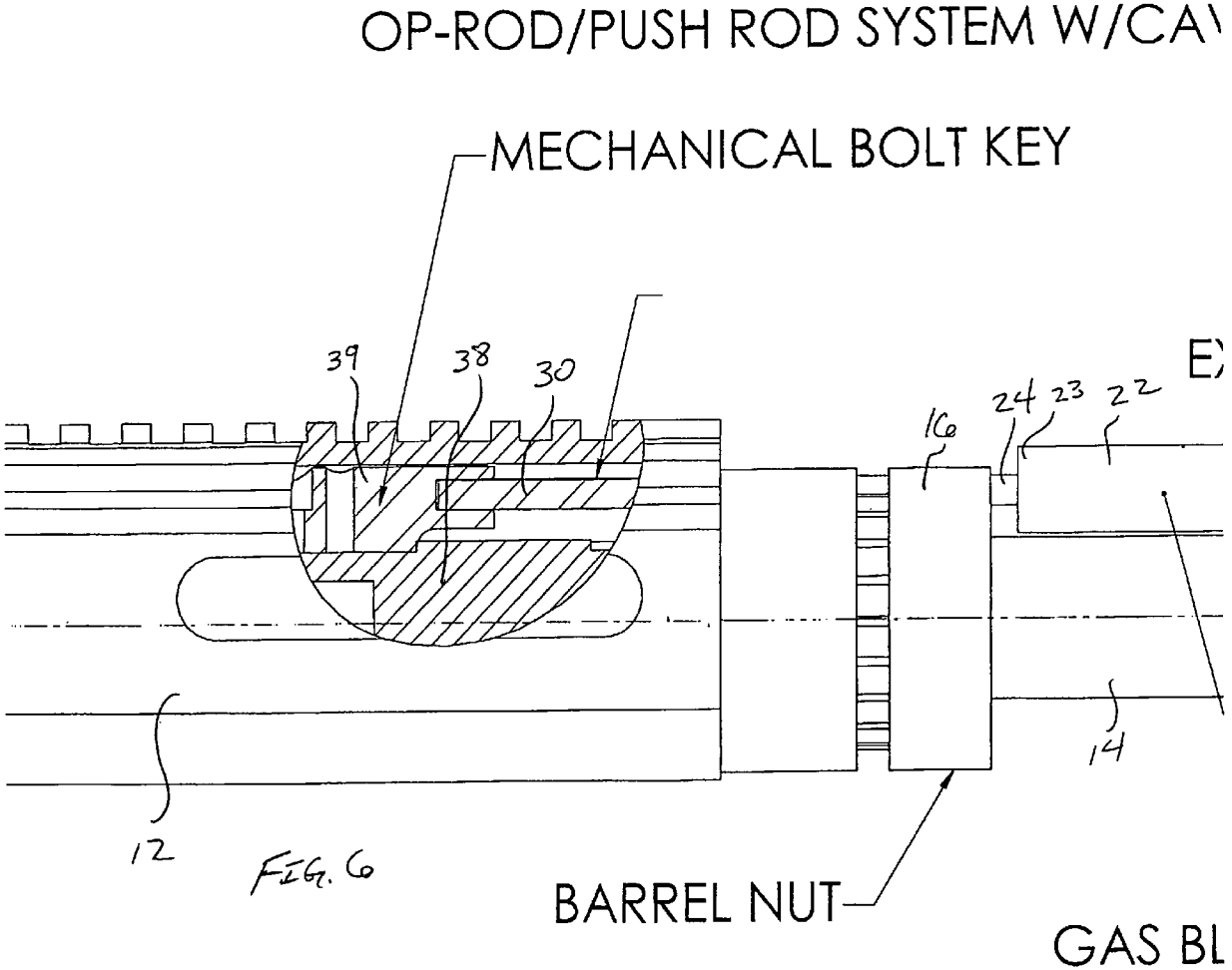
FIG. 6 is an enlarged sectional side view of the rearward portion of the operating system of FIG. 3.

With continued reference to FIGS. 3 and 4, and additional reference to FIG. 6, rod portion 30 of push rod/piston rod 24 extends rearwardly through barrel nut 16 and is received by upper receiver 12. Upper receiver 12 carries a bolt carrier 38 having a mechanical key 39 extending from an upper portion thereof. In a conversion method, the conventional gas key is removed and replaced with mechanical key 39. Rod portion 30 is received against mechanical key 39. As gas from the fired rifle drives push rod/piston rod 24 rearwardly, rod portion 30 drives against key 39 providing the force necessary for the operation of bolt carrier 38 and bolt to cycle through successive firings. Mechanical key 39 can be integrally formed with bolt carrier 38, or attached thereto through fastening mechanisms such as bolts, pins, welding and the like. Also, rod 24 can be biased forwardly by a spring if desired.

Thus provided is a modification to an AR-15/M-16 which can be accomplished employing modified FAL parts or similar newly fabricated parts, on the FAL design and modifications to the bolt carrier of a conventional AR-15/M-16 rifle.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A push rod operating system for a rifle comprising:

a rifle having a barrel coupled to an upper receiver, a bolt carrier carried by the upper receiver, and a mechanical key coupled to the bolt carrier;

a gas block coupled to the barrel, the gas block having a bore therethough;

a rod tube extending from the gas block in communication with the bore, toward the upper receiver;

a gas plug closing the bore of the gas block opposite the rod tube, the gas plug defining a gas chamber therein;

an aperture formed in the barrel for venting discharge gasses, and a pathway for discharge gasses to enter the gas chamber defined by the gas plug;

a piston rod element carried in the rod tube proximate the gas block, the piston rod element having a piston portion reciprocally received within the bore of the gas block and movable between a first position abutting the gas plug to define an operating volume, and a second position; and a push rod element carried by the rod tube and engaging the mechanical key and the piston rod element.

2. A push rod operating system as claimed in claim 1 wherein the piston portion includes a second gas chamber defined therein which adjoins the gas chamber of the gas plug in the first position to jointly define the operating volume.

* * * * *

US007418898C1

(12) EX PARTE REEXAMINATION CERTIFICATE (9333rd)

United States Patent
Desomma

(10) Number: US 7,418,898 C1
(45) Certificate Issued: Oct. 4, 2012

(54) M16 MODIFIED WITH PUSHROD OPERATING SYSTEM AND CONVERSION METHOD

(76) Inventor: Frank Desomma, Glendale, AZ (US)

Reexamination Request:
No. 90/009,975, Jan. 11, 2012

Reexamination Certificate for:

| | |
|---|---|
| Patent No.: | **7,418,898** |
| Issued: | **Sep. 2, 2008** |
| Appl. No.: | **11/056,306** |
| Filed: | **Feb. 11, 2005** |

Related U.S. Application Data

(60) Provisional application No. 60/543,981, filed on Feb. 11, 2004.

(51) Int. Cl.
*F41A 5/26* (2006.01)

(52) U.S. Cl. ..... 89/193; 89/191.02

(58) Field of Classification Search ..... None
See application file for complete search history.

(56) References Cited

To view the complete listing of prior art documents cited during the proceeding for Reexamination Control Number 90/009,975, please refer to the USPTO's public Patent Application Information Retrieval (PAIR) system under the Display References tab.

*Primary Examiner* — Jeffrey R. Jastrzab

(57) ABSTRACT

A push rod operating system for an AR-15/M-16 rifle includes an AR-15/M-16 rifle having a barrel coupled to an upper receiver, a bolt carrier carried by the upper receiver, and a mechanical key coupled to the bolt carrier. A gas block is coupled to the barrel, the gas block having a bore therethough. A rod tube extends from the gas block in communication with the bore, toward the upper receiver. A gas plug has a gas chamber closing the bore of the gas block opposite the rod tube. A discharge gas pathway permits discharge gasses to enter the gas chamber from the barrel. A piston rod element is carried in the rod tube with a piston portion thereof reciprocally received within the bore of the gas block and movable between a first position abutting the gas plug to define an operating volume, and a second position. A push rod element is carried by the rod tube and engages the mechanical key and the piston rod element.

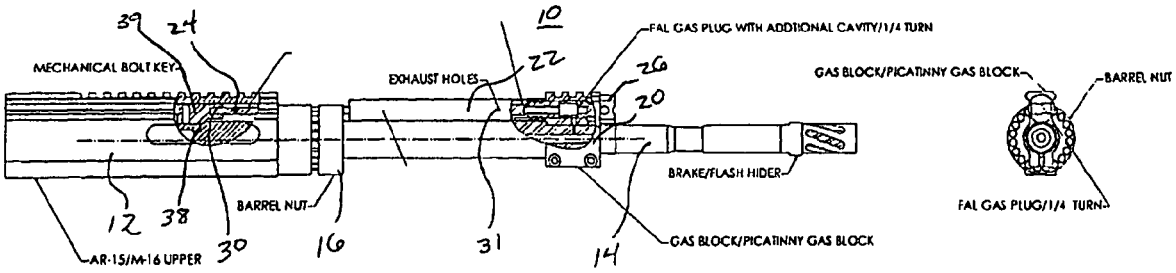

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claim 2, dependent on an amended claim, is determined to be patentable.

New claims 3-6 are added and determined to be patentable.

1. A push rod operating system for a rifle comprising:

a rifle having a barrel coupled to an upper receiver, a bolt carrier carried by the upper receiver, and a mechanical key coupled to the bolt carrier*, the upper receiver comprising a top portion*;

a gas block coupled to the barrel, the gas block [havin] *having:*

*a picatinny style rail aligned with the top portion of the upper receiver; and* a bore [therethough] *therethrough*;

a rod tube extending from the gas block in communication with the bore, toward the upper receiver;

a gas plug closing the bore of the gas block opposite the rod tube, the gas plug defining a gas chamber therein;

an aperture formed in the barrel for venting discharge gasses, and a pathway for discharge gasses to enter the gas chamber defined by the gas plug;

a piston rod element carried in the rod tube proximate the gas block, the piston rod element having a piston portion reciprocally received within the bore of the gas block and movable between a first position abutting the gas plug to define an operating volume, and a second position; and a push rod element carried by the rod tube and engaging the mechanical key and the piston rod element.

*3. A push rod operating system for: an AR-15/M-16 style rifle comprising:*

*a rifle having a barrel coupled to an upper receiver, a bolt carrier carried by the upper receiver, and a mechanical key coupled to the bolt carrier, the upper receiver comprising a first top portion having a first top surface;*

*a handguard removably installed on the first top portion of the upper receiver, the handguard comprising a second top portion having a second top surface;*

*a gas block coupled to the barrel, the gas block comprising;*

*a third top portion having a picatinny style rail, wherein the picatinny style rail is in substantially a same plane as at least one of the first top surface of the upper receiver and the second top surface of the handguard; and*

*a bore therethrough;*

*a rod tube extending from the gas block in communication with the bore, toward the upper receiver;*

*a gas plug closing the bore of the gas block opposite the rod tube, the gas plug defining a gas chamber therein;*

*an aperture formed in the barrel for venting discharge gasses, and a pathway for discharge gasses to enter the gas chamber defined by the gas plug;*

*a piston rod element carried in the rod tube proximate the gas block, the piston rod element having a piston portion reciprocally received within the bore of the gas block and movable between a first position abutting the gas plug to define an operating volume, and a second piston; and a push rod element carried by the rod tube and engaging the mechanical key and the piston rod element.*

*4. A push rod operating system as claimed in claim 3 wherein the piston portion includes a second gas chamber defined therein which adjoins the gas chamber of the gas plug in the first position to jointly define the operating volume.*

*5. A push rod operating system for a rifle comprising:*

*a rifle having a barrel coupled to an upper receiver, a bolt carrier carried by the upper receiver, and a mechanical key coupled to the bolt carrier, the upper receiver comprising a first top portion;*

*a handguard removably installed on the first top portion of the upper receiver, the handguard comprising a second top portion;*

*a gas block coupled to the barrel, the gas block comprising:*

*a picatinny style rail aligned with at least one of the first top portion of the upper receiver and the second top portion of the handguard; and*

*a bore therethrough;*

*a rod tube extending from the gas block in communication with the bore, toward the upper receiver;*

*a gas plug closing the bore of the gas block opposite the rod tube, the gas plug defining a gas chamber therein;*

*an aperture formed in the barrel for venting discharge gasses, and a pathway for discharge gasses to enter the gas chamber defined by the gas plug;*

*a piston rod element carried in the rod tube proximate the gas block, the piston rod element having a piston portion reciprocally received within the bore of the gas block and movable between a first position abutting the gas plug to define an operating volume, and a second position; and a push rod element carried by the rod tube and engaging the mechanical key and the position rod element.*

*6. A push rod operating system as claimed in claim 5 wherein the piston portion includes a second gas chamber defined therein which adjoins the gas chamber of the gas plug in the first position to jointly define the operating volume.*

* * * * *